US005676293A

United States Patent [19]

Farris

[11] Patent Number: 5,676,293

[45] Date of Patent: Oct. 14, 1997

[54] BACKPACK AND METHOD OF USING SAME

[76] Inventor: Beverly Wesley Farris, 11466 Poblado Rd., San Diego, Calif. 92127

[21] Appl. No.: 541,137

[22] Filed: Oct. 11, 1995

Related U.S. Application Data

[63] Continuation-in-part of Ser. No. 310,832, Sep. 22, 1994, abandoned.

[51] Int. Cl.[6] ..... A45F 4/02

[52] U.S. Cl. ..... 224/576; 224/153; 224/579; 224/637; 224/640; 224/655; 224/659; 2/175.7

[58] Field of Search ..... 224/153, 579, 224/655, 659, 576, 637, 640; 2/84, 202, 204, 175.6, 175.7, 94; 602/19

[56] References Cited

U.S. PATENT DOCUMENTS

| | | | |
|---|---|---|---|
| 34,336 | 2/1862 | Sweeney | 224/628 |
| 706,697 | 8/1902 | Sims | 2/175.7 |
| 2,611,519 | 9/1952 | Utterstrom | 224/201 |
| 5,025,965 | 6/1991 | Smith | 224/579 |
| 5,040,524 | 8/1991 | Votel et al. | 602/19 |
| 5,240,159 | 8/1993 | Gregory | 224/628 |

FOREIGN PATENT DOCUMENTS

| | | | |
|---|---|---|---|
| 2948713 | 6/1981 | Germany | 224/153 |
| 2197582 | 5/1988 | United Kingdom | 224/209 |

*Primary Examiner*—Linda J. Sholl

[57] ABSTRACT

The backpack includes a main storage compartment having a back engageable portion, and a pair of shoulder straps attached thereto. A lumbar support member attached to a lower portion of the back engageable portion is attached to the lower ends of each shoulder strap to surround the abdomen of the wearer and provide support to the lumbar region of the wearer's spine. To provide protection to the wearer's head, a hood member is attached to the upper portion of the back engageable portion, and which can be placed over the head of the wearer when desired. Another backpack includes a pair of waist belt members secured at one end thereof to the back engageable portion, and having a storage compartment disposed between the waist belt members for storing them therein. A hood is secured to the back engageable portion by a strap member to space apart the hood from the back engageable portion by a given distance.

6 Claims, 2 Drawing Sheets

BACKPACK AND METHOD OF USING SAME

CROSS-REFERENCE TO RELATED APPLICATIONS

This patent application is a continuation-in-part patent application of U.S. patent application Ser. No. 08/310,832, filed Sep. 22, 1994 now abandoned, and entitled "Backpack and Method of Using Same," which is incorporated by reference as if fully set forth herein.

TECHNICAL FIELD

The present invention relates in general to an improved backpack and a method of using it. The invention more particularly relates to a backpack which protects the head of a wearer during use, and which is worn according to a novel method.

BACKGROUND ART

There have been many types and kinds of backpacks for transporting objects on the back of a wearer. In particular, the use of backpacks by school-age children to carry their school related materials is well known. The backpack is ideal for use by children as their school materials can be safely carried on their backs, leaving their hands free for other activities. For example, athletic activities such as bicycling, basketball, and others which require the backpack wearers to use their hands can be enjoyed while wearing the backpack.

A benefit of being able to participate in activities while wearing a backpack is that the children are able to closely monitor their belongings at all times. Thus, the likelihood that their belongings will be lost or stolen is greatly reduced.

Generally, the backpacks utilized by the school children are of the small daypack or knapsack variety. These backpacks do not have a frame structure to add support. Instead, they are simply constructed to have a collapsible storage compartment which is supported on the back of the students by a pair of shoulder straps. The shoulder straps are attached to the storage compartment to form a pair of openings to receive the arms of a child.

While these backpacks are suitable for use with light loads, they are not adequate for situations where the children must carry heavy loads throughout the school day. This is especially true for school children that are not provided with lockers for storage. Without the benefit of a secure place on the school grounds for storing school supplies, the children are responsible for bringing the necessary school supplies, including textbooks, to school with them everyday. As a result, the daily load which must be born by the students can be quite large.

The biggest drawback of the small backpack normally used by students when carrying heavy objects is the discomfort to the wearer's lower back caused by the objects pulling the student's spine out of its proper alignment. The constant downward force exerted by the heavy load on the student's shoulders, through the shoulder straps, eventually fatigues the wearer until the wearer cannot maintain the proper back position for carrying a heavy load. Once fatigue sets in, the muscles of the lower back, or lumbar region, become stressed or injured and induce pain and discomfort in the wearer's back.

In addition to the discomfort due to fatigued back muscles as just described, the act of placing the backpack over the child's shoulders and into place on the back is very difficult with a heavy load. In this regard, the openings formed by the shoulder straps are very close together. When putting the backpack on, the student must lift the backpack up and reach back to insert an arm into an opening. Then, with the backpack behind the student, the other arm must be passed through the remaining opening. This is a very difficult task as the openings are very close to one another, causing the wearer to have to rotate the shoulders backward and inward to enable the last arm to pass through the final opening.

While such an arrangement works with light loads, it is not adequate for use with heavy loads. By causing the shoulders to rotate backward and inward, the strength of the wearer's arm and shoulder muscles is greatly reduced. Thus, it is extremely difficult for students to insert their arms through the openings formed by the shoulder straps of the ordinary backpack when attempting to position a heavy load within the backpack on the back of the wearer.

Therefore, it would be highly desirable to have a new and improved backpack which reduces the likelihood of injury while being comfortable, and which is light weight and inexpensive to manufacture. Such a new and improved backpack must be easy to position onto the back of a wearer while storing heavy objects therein.

Commonly, school children must await the start of a school day, or otherwise spend time, outdoors. While outdoors, the students are exposed to the weather conditions which can be extremely harsh. For example, the students may have to walk to and from school, wearing their backpacks, during a thunderstorm or snow storm. As a result, the children are not provided with the proper protection which leads to the children being uncomfortable as they may be cold and wet. While raincoats with hoods may be worn under the backpack, it is a very awkward maneuver for the wearer to pull the hood out from between their back and their backpack and place the hood into position. Furthermore, although the use of a hat is easy enough, small children can easily lose an article of clothing such as a hat during their school day.

Therefore, it would also be highly desirable to have a new and improved backpack which can provide protection for the head of a wearer in a quick and easy manner.

A rucksack or backpack with a hood for covering the head of a wearer is described in United Kingdom patent publication GB 2 197 582 A. The rucksack includes a main storage compartment having a pair of shoulder straps attached thereto for supporting the rucksack from the shoulders of the wearer. The hood is attached directly to the main storage compartment at a location adjacent to the neck of the wearer when in use. In this way, the hood can be worn while the rucksack is positioned on the back of the wearer. The rucksack further includes a hood storage compartment having a zipper closure apparatus for storing the hood when it is not in use.

Although the rucksack with the attached hood adequately provides protection from the weather for the wearer, such a rucksack is not suited for younger wearers, including school age children. School age children travelling to and from school often carry books and other heavy objects within the main storage compartment. These books and heavy objects tend to exert a downward pull on the hood where it is secured to the main storage compartment.

As a result of the downward pull caused by the heavy objects, the hood is pulled downwardly by the main storage compartment and its contents, thereby exerting a downwardly directed force to the head of the wearer. The neck muscles of the wearer must then compensate to keep the head upright. After an extended period of such compensating muscle activity, the wearer is subject to suffering from sore and possibly aching muscles.

Another drawback to the hooded rucksack potentially exists when the rucksack is worn by the wearer in an unintended manner, a distinct possibility for school age children. In particular, the possibility of neck and head injuries may arise if the rucksack is supported from the head only with the hood, leaving the main storage compartment resting unsecured on the back of the wearer. In this situation, the weight of the objects in the main storage compartment would be supported by the head only of the wearer, thereby increasing the possibility of neck muscle fatigue. In addition, a sudden downward pull on the main storage compartment from behind by a playful companion could cause the hood to be jerked backwardly, resulting in an injury to the neck or head.

Therefore, it would also be highly desirable to have a new and improved hooded backpack which is comfortably supported on the wearer, and which is suitable for use by school age children.

DISCLOSURE OF INVENTION

Therefore, the principal object of the present invention is to provide a new and improved backpack and a method of wearing it, wherein the backpack reduces the likelihood of injury while being comfortable, and which is light weight and inexpensive to manufacture. Such a new and improved backpack must be easy to position onto the back of a wearer while storing heavy objects therein.

Another object of the present invention is to provide a new and improved backpack wherein the head of the wearer can be quickly and easily protected from the elements.

Another object of the present invention is to provide a new and improved backpack which is safe for use by school age children.

Briefly, the above and further objects of the present invention are realized by providing a new and improved backpack, which can be worn according to a novel method of the present invention.

The backpack includes a main storage compartment having a back engageable portion, and a pair of shoulder straps attached thereto. A lumbar support member attached to a lower portion of the back engageable portion is attached to the lower ends of each shoulder strap to surround the abdomen of the wearer and provide support to the lumbar region of the wearer's spine. To provide protection to the wearer's head, a hood member is attached to the upper portion of the back engageable portion, and which can be placed over the head of the wearer when desired. Another backpack includes a pair of waist belt members secured at one end thereof to the back engageable portion, and having a storage compartment disposed between the waist belt members for storing them therein. A hood is secured to the back engageable portion by a strap member to space apart the hood from the back engageable portion by a given distance.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
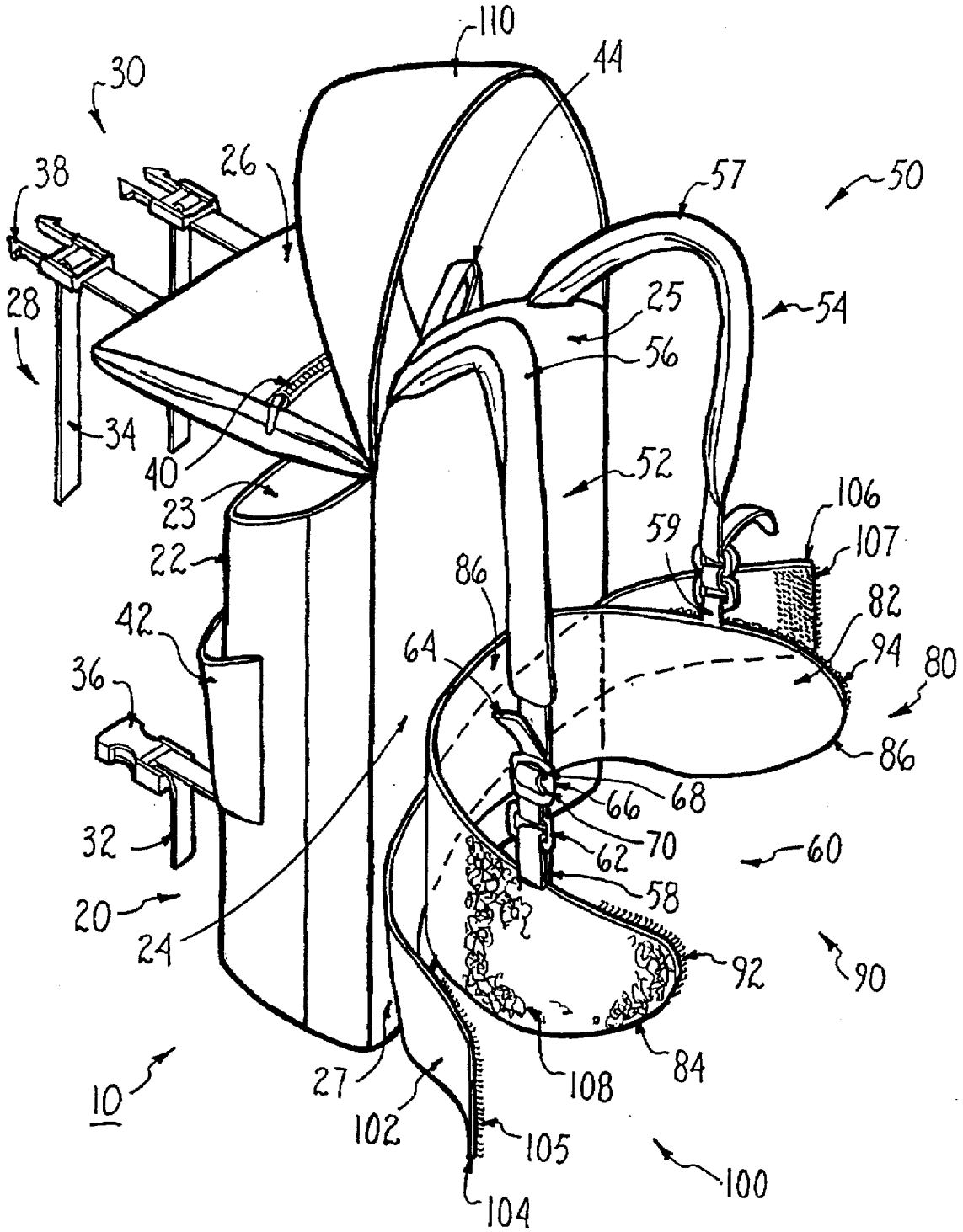
FIG. 1 is a perspective view of a backpack, which is constructed in accordance with the present invention.

Referring now to FIG. 1, there is shown a backpack 10, which is constructed in accordance with the present invention. The backpack 10 can be readily worn by a wearer in accordance with the method of the present invention.

The backpack 10 generally comprises a storage section 20, comprising an outer wall 22 connected to a back engageable wall 24 to form a storage compartment 23 for storing objects therein. The outer wall 22 and the back engageable wall 24 are constructed from a supple material, for example, a nylon or canvas material, to enable the backpack 10 to be readily collapsed for storage purposes, yet be sufficiently strong to support an object within.

A shoulder strap arrangement 50 is attached to an upper portion 25 of the back engageable wall 24 for supporting the storage section 20 from the shoulders of the wearer. The shoulder strap apparatus 50 is connected to a lumbar support apparatus 80 thereby forming the framework from which the storage section 20 is supported by the wearer. The lumbar support apparatus 80 is attached to the back engageable wall 24 at a lower portion 27 thereof, and is intended to surround the abdomen of the wearer to support the storage section 20 on the lower back of the wearer, and to help maintain the lumbar region of the wearer in a relatively vertical position.

The lumbar support apparatus 80 includes a lumbar support belt 82 having end portions 84 and 86 for encircling the abdomen. A closure apparatus 90 cooperates with the end portions 84 and 86 to secure them to one another, thereby preventing slippage of the lumbar support belt 82 along the back of the wearer.

A hood 110 is attached to the storage section 20 at the upper portion 25 for partially enclosing the head of the wearer. In this way, the wearer can protect the head and retain body heat to add to the wearer's comfort. The hood 110 may be constructed from the same material used to construct the storage section, and the hood 110 may also be constructed of a water resistant or waterproof material to add to the wearer's comfort in wet conditions.

In use, the arms of the wearer are passed through the shoulder strap apparatus 50 until the apparatus 50 is placed over the shoulders of the wearer, wherein the back engageable wall 24 engages the back of the wearer and the ends 84 and 86 extend out from the wearer. The lumbar support belt 82 is positioned to engage the wearer's lower back area, thereby supporting the storage portion 20 on the lower back of the wearer. As the ends 84 and 86 are brought together, the lumbar support belt 82 exerts a straightening force on the lumbar region of the wearer, wherein the lumbar region is automatically positioned into a relative vertical position. Once the lumbar support belt 82 is tight enough to ensure that it will not slip along the back of the wearer while maintaining the lumbar region in the vertical position, the ends 84 and 86 are secured with the closure apparatus 90.

Once the backpack 10 is in place, the hood 110 may be grasped by the wearer and brought over the head as desired.

Considering now the construction of the backpack 10 in greater detail, the storage section 20 includes a flap member 26 for enclosing the storage compartment 23. In this regard, the flap member 26 is connected to the upper portion 25 and folds down over the outer wall 22, thereby enclosing the storage compartment 23.

A pair of retaining strap members 28 and 30 cooperate with the outer wall 22 and the flap member 26 to secure the flap member 26 in position over the storage compartment 23. As the strap members 28 and 30 are substantially similar, only strap member 28 will be considered now in further detail. Strap member 28 includes a strap 32 attached to the outer wall 22 and which passes through a female buckle member 36. A strap 34 is connected to the flap member 26 and passes through a male buckle member 38. Male buckle member 38 cooperates with female buckle member 36 to secure the flap member 26 to the outer wall member 22.

In order to provide additional storage area, the flap member 26 may include another storage compartment (not shown) which may be accessed by a zipper member 40. Also an outer pocket member 42 is attached to outer member 22 and is readily accessible from the outside. To facilitate the storage of the backpack 10 when not in use, a loop member 44 is attached to the storage section 20 to facilitate the placing of the backpack on a hook or other similar device.

Considering now the shoulder strap apparatus 50 in greater detail, the apparatus 50 includes a pair of shoulder straps 52 and 54. Shoulder straps 52 and 54 include upper end portions 56 and 57 attached to the upper portion 25 of the back engageable wall 24. The shoulder straps 52 and 54 are connected at their lower end portions 58 and 59 to the ends 84 and 86, respectively, of the lumbar support belt 82.

Upper end portions 57 and 59 are spaced apart from one another to permit the shoulder straps 52 and 54 to rest on the shoulders of the wearer on either side of the wearer's head. Unlike the upper portions 57 and 59 which are fixed, lower end portions 58 and 59 are able to be moved apart from one another, or to be brought together, to vary the width between them. In this way, the end portions 58 and 59 can be spread apart to enable the arms of the wearer to comfortably pass through the shoulder straps 52 and 54, placing the shoulder straps 52 and 54 over the wearer's shoulders, and then permit the end portions 58 and 59 to be brought back together wherein they are secured to one another.

By allowing the lower end portions 58 and 59 to be spread apart, wearers of varying size can use the backpack 10. In this regard, the lower end portions 58 and 59 may be spaced apart from one another to accommodate the girth of the wearer at the abdomen to provide a comfortable fit.

Furthermore, the ability to spread apart lower end portions 58 and 59 facilitates the slipping on and removing of the backpack 10 when a heavy object is contained therein. by spreading the end portions 58 and 59 apart, the wearer is not required to strain to insert his or her arms under the shoulder straps 52 and 54. Thus, the amount of shoulder strength required to hold the heavy load while putting the backpack 10 on, or when removing it, is greatly reduced.

As shoulder straps 52 and 54 are substantially similar, only shoulder strap 52 will be considered hereinafter in greater detail. Shoulder strap 52 further includes an adjustment device 60 for varying the length of the shoulder strap 52. To facilitate the length adjustment, the adjustment device 60 includes a ring member 62 secured to the end 84 by lower end portion 58, an adjustment strap 64 to loop through ring member 62 to connect the upper end portion 56 to the lower end portion 58, and a buckle member 66 having openings 68 and 70 therein for receiving and securing the strap 64. In this regard, strap 64 is passed through openings 70 and 68 before being passed through ring member 62. The strap 64 is then doubled back and passed back through opening 68 and 70 to secure the strap as desired.

Considering now the lumbar support apparatus 80 in greater detail, the lumbar support belt 82 is constructed of semi-rigid material capable of being slightly stretched while maintaining its shape, yet supple enough to not cause discomfort to the wearer, such as nylon. The lumbar support belt 82 is sized and shaped to extend over the lumbar region of the wearer to facilitate aligning the spine of the wearer, thereby enabling the wearer to maintain the correct body position for transporting heavy loads without injuring the wearer's lower back.

The ends 84 and 86 are secured to one another with closure arrangement 90. In this regard, closure arrangement 90 includes a hook member portion 92 attached to end 84 which cooperates with a loop member portion 94 attached to end 86. Once ends 84 and 86 are positioned as desired to provide an adequate amount of support for the wearer's lower back, the hook member portion 92 is engaged with the loop member portion 94, thereby securing the ends 84 and 86 to one another.

The lumbar belt apparatus 80 further includes an elastic belt assembly 100 to adjust the tension of the lumbar belt 82, thereby accommodating wearers having different abdomen circumferences. The elastic belt assembly 100 provides additional support to the lower back area in the form of increased torsional force applied to both belt ends 84 and 86. The elastic belt assembly 100 includes an elastic belt 102 having ends 104 and 106. Elastic belt 102 includes hooked member portions 105 and 107 attached to ends 104 and 106, respectively. In addition, the elastic belt assembly 100 includes a loop member portion 108 attached to end 84 to cooperate with the hooked member portion 105.

In operation, the elastic belt assembly 100 is adjusted to supply the proper amount of torsional force to each one of ends 84 and 86 to accommodate the wearer. To adjust tension of elastic belt assembly 100 for use by other wearers, the adjustment strap 102 is stretched, and ends 104 and 106 are secured to the belt ends 84 and 86, wherein the hooked member portion 105 cooperates with the looped member portion 108 to secure end 104 to end 84, and wherein hooked member portion 107 cooperates with looped member portion 94 to secure end 106 to end 86. In this way, the elasticity of strap 102 causes the ends 84 and 86 to be pulled toward the back engageable wall 24. As a result, the stiffness of lumbar support belt 82 is increased to provide additional support to the lumbar region of the wearer, helping to maintain the wearer's back in a relatively vertical position.

The lumbar support belt 82 is then secured to the abdomen of a wearer by grasping belt ends 84 and 86 and bringing the ends 84 and 86 together and securing them to one another by engaging the hooked end portion 92 with the looped end portion 94.

Considering now the hood 110 in greater detail, the hood 110 is attached to the upper portion 25 along the entire width of the back engageable wall 24. The hood 110 is shaped to accommodate the head of a wearer and is sized to permit the hood 110 to extend over the head while the backpack is being worn by the wearer.

Figures 2, 3:
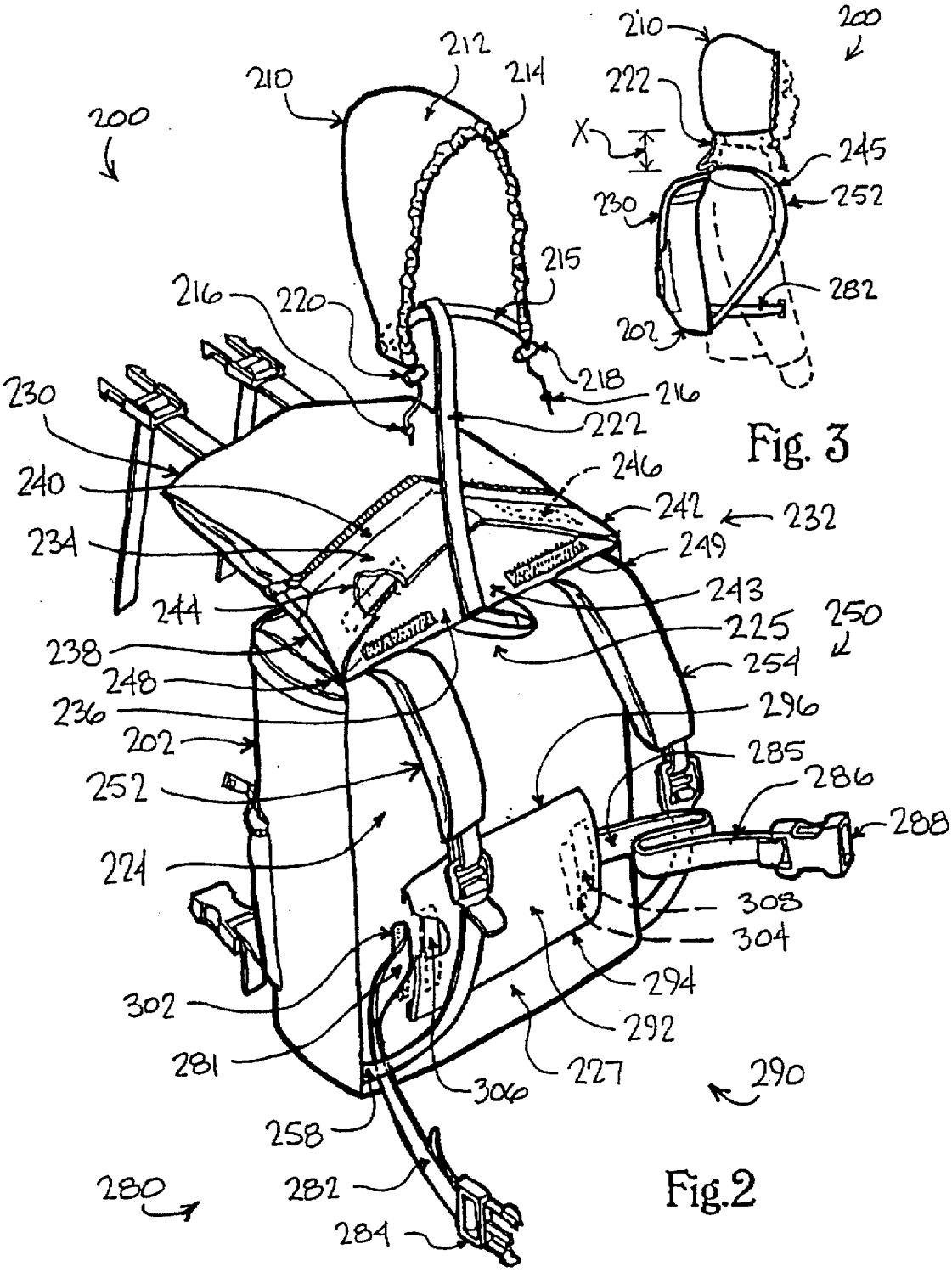
FIG. 2 is a perspective view of another backpack, which is also constructed in accordance with the present invention.
FIG. 3 is a reduced size side view of the backpack of FIG. 2 in use.

Referring now to FIGS. 2 and 3 of the drawings, there is shown another backpack 200 which is also constructed in accordance with the present invention. The backpack 200 is substantially similar to the backpack 10 (FIG. 1), and includes a main storage compartment 202 and a flap 230 for enclosing the compartment 202. The compartment 202 has a back engageable wall 224 and shoulder straps 252 and 254 attached thereto for carrying objects to be transported. Unlike the straps 52 and 54 of the backpack 10 (FIG. 1), straps 252 and 254 are secured at lower ends 258 and 259 thereof to the back engageable wall 224.

A hood 210 having a head engageable portion 212 and a bottom fold 215 is secured to an upper portion 225 of the back engageable wall 224 by an elongated strap 222 to tether the hood 210 to the compartment 202 to prevent the accidental loss of the hood 210. The hood 210 is substantially free from the compartment 202 to reduce the risk of injury to the wearer, and the hood 210 is adapted to be spaced apart from the back engageable upper portion 225 by a given distance X.

The strap 222 is sufficiently long to be slack when the backpack 200 is worn in the intended manner as shown in FIG. 3, wherein the strap 222 is at least substantially equal to two and one half times the length of the given distance X to provide the slack for preventing the hood 210 from helping to support the weight of the objects within the compartment 202. The length of the strap 222 is also sized to discourage the supporting of the backpack 200 by the head alone, without the additional support provided by the shoulder straps 252 and 254.

By sizing the strap 222 to be sufficiently long, the compartment 202 is supported at about the mid to lower portion of the back of the wearer when the compartment 202 is supported by the head alone. In this position, the compartment 202 will tend to swing freely and will restrict the freedom of the wearer, thereby dissuading the wearing of the backpack 200 in such an unintended fashion.

To accommodate wearers of varying sizes, the length of strap 222 is at least about eight inches long. To prevent the strap 222 from forming too much slack, which could be accidentally grasped, causing the head of the wearer to be suddenly jerked backwardly, the length of the strap 222 is limited to be less than about eighteen inches. The strap 222 is more preferably between about ten inches and about sixteen inches. The length of the strap 222 is most preferably between about twelve inches and about fourteen inches. In this way, the given distance X will be maintained to be about two and one half times the length of the strap 222 for wearers of varying sizes, yet reduce the likelihood that the strap 222 will be inadvertently jerked backwardly.

In use, the arms of the wearer pass between shoulder straps 252 and 254 and the back engageable wall 224 to position and support the main storage compartment 202 on the back of the wearer. If desired, the hood 210 can be positioned on the head of the wearer to provide protection from the weather. Once the hood 210 is in place, the strap 222 is slack, thereby permitting the hood 210 and the main storage compartment 202 to move independently from one another. Furthermore, the hood 210 is spaced apart from the upper portion 225 by the safe distance X to reduce substantially the risk of injury to the head or neck of the wearer.

The wearing of the backpack 200 in the intended manner is facilitated by the length of the strap 222. In this regard, should the backpack 200 be supported by the hood 210 alone, the main storage compartment 202 will swing freely from the hood 210 and will engage the low to middle portion of the back of the wearer due to the length of the strap 222. The position of the main storage compartment 202 when the backpack 200 is worn in this unintended manner will tend to be uncomfortable, and will dissuade the wearer from wearing the backpack 200 in this manner.

The hood 210 further includes a channel 214 connected to the head engageable portion 212 for enclosing a draw string 216 therein. The size of the hood 210 is adjusted by pulling on the draw string 216 to shorten the length of the channel 214. A pair of quick release securing devices 218 and 220 prevent the draw string 216 from being pulled into the channel 214 to secure the hood 210 on the head of the wearer.

In order to store the hood 210 and the strap 222 when not in use, the backpack 200 further includes a hood storage compartment 232 connected to the flap 230. The compartment 232 includes a bottom wall 236 secured to the upper portion 225, and an upper member 234 secured to the bottom member 236 along seams 238, 240 and 242 for forming an opening 243 to receive the hood 210 and strap 222 therein. A pair of hooked securing members 244 and 246 fixed to the upper member 234 cooperate with a pair of looped securing members 248 and 249 fixed to the bottom member 236 to help maintain the hood 210 and the strap 222 within the compartment 232 when not in use.

A waist belt apparatus 280 is attached to a lower portion 227 of the back engageable wall 224 for helping to support the main storage compartment 202 when desired. In order to store the waist belt apparatus 280 when not in use, a waist belt storage compartment 290 is attached to the lower portion 227.

Considering now the waist belt apparatus 280 in greater detail, the waist belt apparatus 280 includes a pair of waist belt straps 282 and 286 having proximal ends 281 and 285 thereof attached to the lower portion 227 in a spaced apart manner. A male connector member 284 and a female connector member 288 coupled to the waist belt straps 282 and 286, respectively, enable the lower portion 227 to be held releasably and securely against the back of the wearer.

Considering now the waist belt storage compartment 290 in greater detail, the compartment 290 includes a rectangular member 292 secured to the lower portion 227 between the belt ends 281 and 285. The member 292 is secured along opposite sides 294 and 296 thereof to form a pair of opening s to receive the belt straps 282 and 286. A pair of hooked securing members 302 and 304 are fixed on the lower portion 227 and cooperate with a pair of looped securing members 306 and 308, respectively, to help retain releasably the waist belt straps 282 and 286 within the compartment 290.

While the invention has been described with regard to frameless backpacks, it should be understood that the invention will function equally well with backpacks having frames, including both externally and internally framed backpacks.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A backpack, comprising:

a back engageable portion being adapted to be worn on the back of the wearer and including a storage compartment having an opening thereto for receiving and supporting objects to be transported therewithin;

a pair of shoulder straps attached to said back engageable portion at an upper portion thereof and a lower portion thereof for helping to support the backpack on the wearer;

a hood arrangement including a hood adapted to be worn on the head of the wearer and secured to said upper portion for covering and protecting the head of the wearer, said hood arrangement further including an elongated strap member connected between said hood and said back engageable upper portion for tethering said hood to said back engageable portion to help prevent the inadvertent loss of said hood and to be substantially free from one another for reducing substantially the risk of injury to the wearer;

said strap being permanently connected to said hood and said upper portion such that said strap remains positioned behind the wearer when said hood and back engageable portion are in use on the wearer; and wherein said hood and said back engageable portion are adapted to be worn spaced apart from one another by a given distance and said strap is sufficiently long to be substantially greater in length than said given distance, said strap length being at least substantially equal to two and one half times the length of said given distance to provide a substantial amount of slack to prevent said hood from helping to support the weight of the loaded back engageable portion when worn by the user and to discourage supporting the loaded back engageable portion from the head by avoiding the use of the shoulder straps, said strap being at least about eight inches in length.

2. A backpack according to claim 1, wherein said strap length is less than about eighteen inches.

3. A backpack according to claim 2, wherein said strap length is more preferably between about ten inches and about sixteen inches.

4. A backpack according to claim 3, wherein said strap length is more preferably between about twelve inches and about fourteen inches.

5. A backpack according to claim 2, wherein said body engageable portion further includes a flap member secured to said upper portion for enclosing said storage compartment opening, said flap member including a reclosable compartment disposed adjacent to said upper portion for storing said hood.

6. A backpack according to claim 5, further including:

a waist belt arrangement attached to said back engageable portion at said lower portion for encircling the waist of the wearer to help support the backpack therefrom, said waist belt arrangement including a right belt member and a left belt member secured at one end thereof to said lower portion and releasably connected to one another at another end thereof; and a sleeve member having a pair of closable oppositely disposed openings attached to said lower portion intermediate said right belt member and said left belt member for receiving and securing them therewithin.

* * * * *